US005672118A

United States Patent [19]

Robbie

[11] Patent Number: 5,672,118

[45] Date of Patent: Sep. 30, 1997

[54] GOLF SWING TRAINER

[76] Inventor: Paul Robbie, 19123 Hamlin St., #6, Reseda, Calif. 91335

[21] Appl. No.: 647,574

[22] Filed: May 13, 1996

[51] Int. Cl.[6] ..... A63B 69/36

[52] U.S. Cl. ..... 473/257; 473/392; 473/396; 473/400; 473/401

[58] Field of Search ..... 473/146, 149, 473/268, 393, 396, 257, 392, 400, 401

[56] References Cited

U.S. PATENT DOCUMENTS

| | | | |
|---|---|---|---|
| 1,948,284 | 2/1934 | Breitbarth | 473/396 X |
| 2,976,040 | 3/1961 | Bales | 273/26 |
| 2,976,041 | 3/1961 | White | 273/26 |
| 3,164,386 | 1/1965 | Fink | 473/149 |
| 3,424,457 | 1/1969 | Robertson | 473/396 X |
| 3,853,325 | 12/1974 | Easterbrook | 473/268 |
| 3,975,024 | 8/1976 | Stephen | 273/193 R |
| 3,999,765 | 12/1976 | Bishop | 273/183 |
| 4,175,744 | 11/1979 | Llewellyn | 473/149 X |
| 4,407,503 | 10/1983 | Nishizawa | 473/149 |
| 4,451,036 | 5/1984 | Sinclair et al. | 273/26 R |

FOREIGN PATENT DOCUMENTS

| | | | |
|---|---|---|---|
| 6-198012 A | 7/1994 | Japan | A63B 69/36 |
| 2 268 081 | 1/1994 | United Kingdom | A63B 57/00 |

OTHER PUBLICATIONS

"Novel Tee Helps Beat Golf Gale," *The Washington Daily News*, Tuesday, Feb. 5, 1924.

*Primary Examiner*—Geroge J. Marlo

*Attorney, Agent, or Firm*—Lewis Anten, Esq.; Amedeo Ferraro, Esq.

[57] ABSTRACT

A golf swing trainer consists of a support base for supporting a vertical shaft, the shaft having a flexible horizontal shaft extending from it and having at its other end a golf tee upon which a golf ball can rest. The horizontal shaft is capable of moving up and down in a vertical direction on the vertical shaft and remains relatively fixed to the vertical shaft by a suitable means. A player would practice using the golf swing trainer by hitting golf balls placed on the tee, initially when the horizontal shaft is at a high position relative to the support shaft, and when the player become adept at hitting the ball at the high position, the horizontal shaft would gradually be lowered, so that the player would be hitting the ball at lower and lower positions. This promotes the proper swing plane for the golf swing.

5 Claims, 2 Drawing Sheets

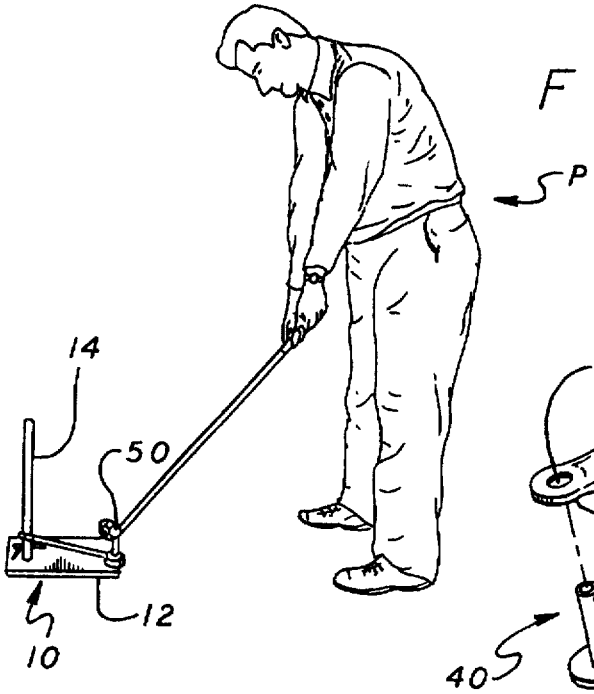
FIG. 6
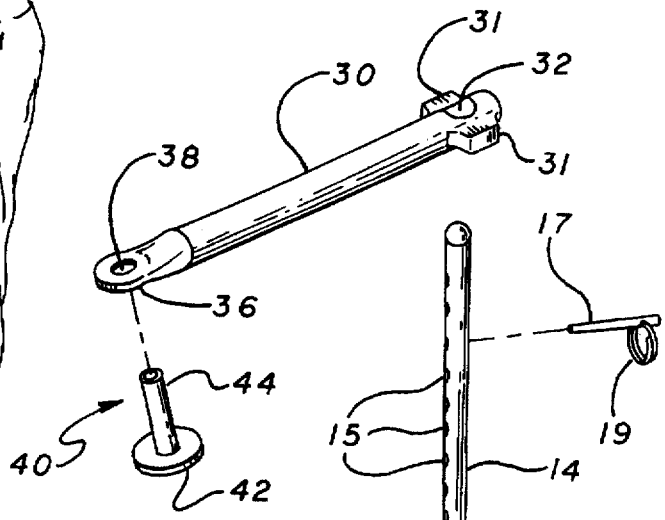
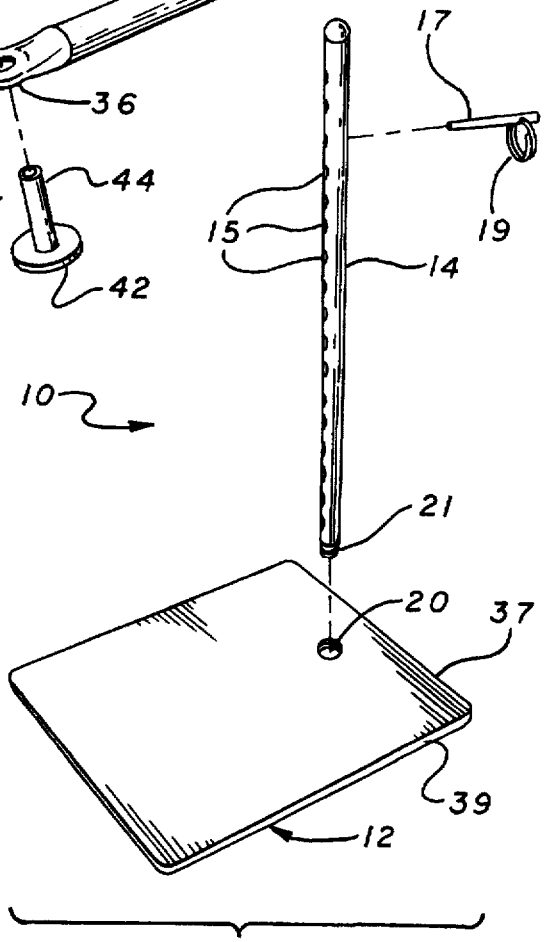
FIG. 3
FIG. 5
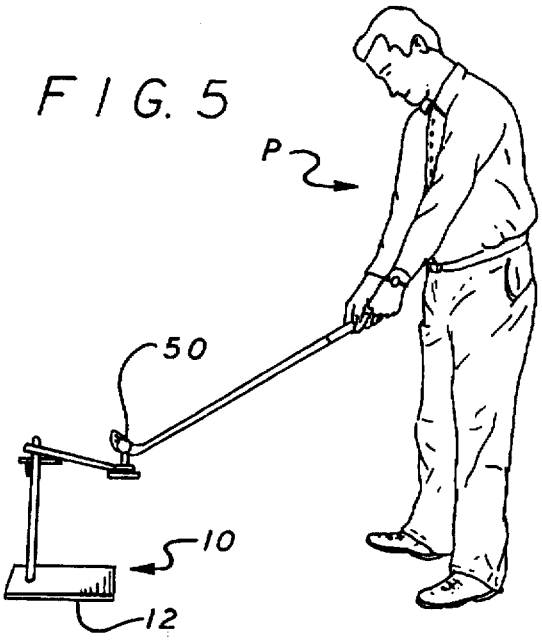

GOLF SWING TRAINER

BACKGROUND OF THE INVENTION

There have been numerous books written concerning the proper golf swing. It is generally recognized that the proper golf swing creates what is known as a flat plane, similar to a baseball swing. This is in contradistinction to a swing that would be more vertical, similar to a ferris wheel. Since most golf swings are taken with the ball close to the ground, usually on a golf tee, it is difficult for the player to practice the swing that creates a flatter plane.

There have been devices that have resulted in a raised tee, such as shown in Japanese Patent No. 406198012 (A) to Shiyokusan to be used in order to create a flat swing plane. In the Shiyokusan patent, a complicated camming structure is used to permit a golf ball to be set at desired heights above the ground. The device of Shiyokusan operates by having the ball rest on a tee mounted on two intersecting and connected members which both ride up and down the central vertical shaft so that as one rises, the other is lowered. This complicated structure permits the orientation of the tee to be maintained vertical, or parallel to the central axis of the vertical shaft. However, the Shiyokusan device is costly to make and cumbersome to assemble and transport to a golf practice range. Further the Shiyokusan device does not permit easily hitting the ball resting on the tee, since the two arms are proximate the swing path of the golf club. The user of the Shiyokusan device, in hitting the structure, could result in either damage to the structure or the golf club and could injure the user.

The patent to Bales, U.S. Pat. No. 2,976,040, uses a tether-like structure in which a golf ball is suspended from a horizontal shaft on a string. Hitting a ball floating in the air does not provide a realistic environment for practicing a golf swing. The tethered golf ball of Bales merely rotates about the horizontal shaft.

The patent to Bishop, U.S. Pat. No. 3,999,765, is designed for use with a short club and can not be used with a full length club. It is not designed to promote a flat swing plane. Similarly, U.K. Patent No. GB 2,268,081 to Beswick is not designed for creating a flat swing plane.

SUMMARY OF THE INVENTION

The present invention is a golf swing trainer consisting of a support base for supporting a vertical shaft. The vertical shaft has a generally horizontal shaft extending from it. The horizontal shaft is capable of moving up and down on the vertical shaft and is capable of being fixed at different points along the vertical shaft by suitable means. A rubber golf tee for holding a golf ball is mounted at one end of the horizontal shaft.

A player would practice using the golf swing trainer by hitting golf balls placed on the tee, initially when the horizontal shaft is in an upper position relative to the vertical shaft. When the player becomes adept at hitting the golf ball at the upper position, the horizontal shaft would gradually be lowered, so that the player would be hitting the golf ball at lower and lower positions until the horizontal shaft is next to the ground.

OBJECTS OF THE PRESENT INVENTION

It is an object of the present invention to provide a golf swing trainer that is easy to use.

It is another object of the present invention to provide a golf swing trainer that is less expensive to manufacture.

It is a further object of the present invention to provide a golf swing trainer that is less complex to assemble.

It is still another object of the present invention to provide a golf swing trainer that is less likely to be damaged during use.

These and other objects of the present invention will be apparent from a review of the following description and accompanying drawings.

BRIEF DESCRIPTION OF THE DRAWINGS

FIG. 3 is a exploded view of the component parts of the golf swing trainer of the present invention.

FIG. 5 is an illustration showing use of the golf swing trainer of the present invention at an upper position.

FIG. 6 is an illustration showing use of the golf swing trainer of the present invention at a lower position.

DETAILED DESCRIPTION OF THE DRAWINGS

Figure 1:
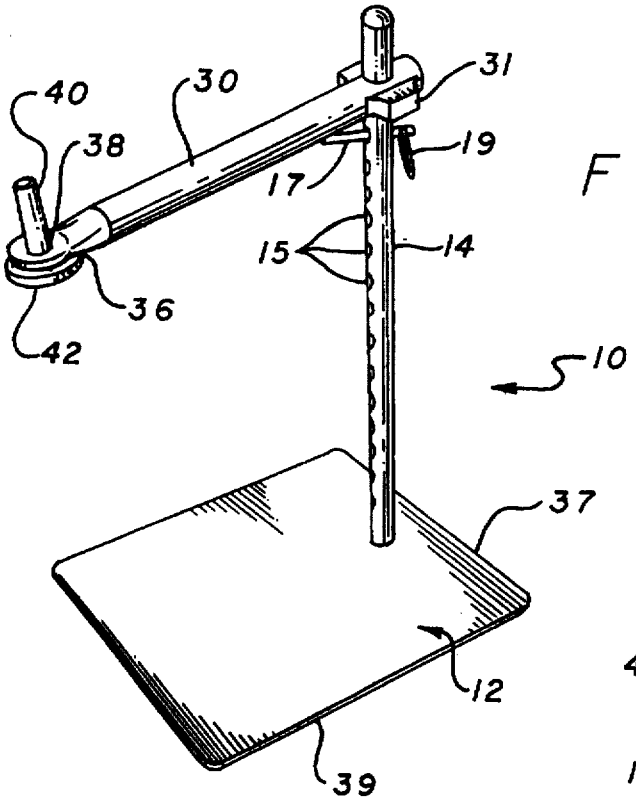
FIG. 1 is a perspective view of the golf swing trainer of the present invention.
Figure 2:
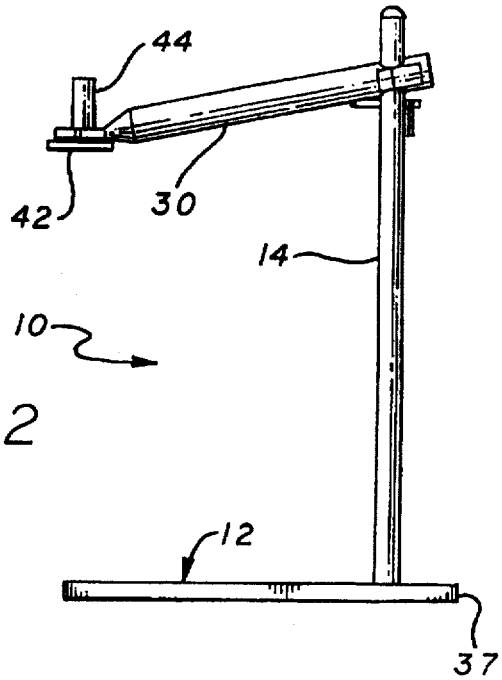
FIG. 2 is a side view of the golf swing trainer of the present invention.
Figure 4:
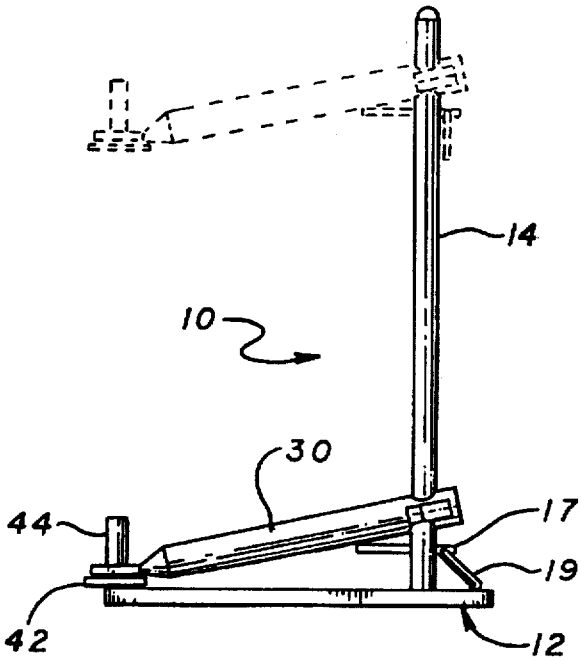
FIG. 4 is a side view of the golf swing trainer of the present invention with the tee in a lower position and showing in dotted line the tee in a higher position.

Referring to the Figures, the preferred embodiment of the golf swing trainer of the present invention will be described. The golf swing trainer is generally referred to by the numeral 10. The golf swing trainer 10 has a rectangular support plate 12 and a vertical shaft 14 that is connected to the support plate 12 by suitable means, such as by threading threads 21 at one end of the vertical shaft 14 into an opening 20 in the support plate 12. In the preferred embodiment of the golf swing trainer 10, the vertical shaft 14 is a cylindrical metal tube, but it is appreciated that it can be other shapes and made of other materials. The vertical shaft 14 has a series of openings 15 for receiving a pin 17, having a loop 19 at one end. Extending from the vertical shaft 14 is a horizontal shaft 30, slidably mounted on vertical shaft 14. In the preferred embodiment the horizontal shaft 30 has an opening 32 slightly larger than the diameter of the vertical shaft 14, so that it can be moved freely up and down the vertical shaft 14 and so that the horizontal shaft 30 may be mounted at a slight downward angle with respect the support plate 12. The height of the horizontal shaft 30 relative to the support plate 12 is selected by inserting the pin 17 in one of the openings 15 in the vertical shaft 14.

In the preferred embodiment, the horizontal shaft 30 is made of a high impact resilient plastic, such as ABS or PVC plastics which are well known. A resilient material is preferred to prevent damage to a golf club in the event of a misplaced swing. The horizontal shaft 30 is provided with ribs 31 to reduce the possibility of breakage by strengthening the area around the opening 32.

At the other end of the horizontal shaft 30 is a flattened portion 36 having an opening 38 for holding a flexible rubber golf tee 40 having a wide base 42 and a narrow upper cylindrical portion 44 which fits into the opening 38 of the horizontal shaft 30. The golf tee 40 is held in place in the opening 38 by friction. The flattened portion 36 is at a slight angle to the central axis of the horizontal shaft 30 and is the compliment angle to the downward angle of the horizontal shaft 30 with respect to the vertical shaft 14. The angle of the flattened portion 36 with respect to the horizontal shaft 30 and the angle of the horizontal shaft 30 with respect to the vertical shaft 14 serve to orient the flattened portion 36 so that it is generally horizontal to the support plate 12.

In the preferred embodiment of the golf swing trainer 10, the base 12 is approximately 11 inches (27 cm) by 12 inches (30 cm). The opening 20 is located approximately 1½ inches (3.5 cm) from the rear edge 37 of the base 12 and approximately 5 inches (12.5 cm) from the side edge 39. This position promotes stability of the unit to prevent its tipping over during use. The vertical shaft 14 is approximately 17½ inches (50 cm) high and has a diameter of approximately 1¾ inches (2.0 cm). There are approximately fifteen openings 15, spaced at 1 inch (2.5 cm) intervals. The diameter of each of the openings 15 is approximately 3/16 inches (0.5 cm). The horizontal shaft 30 is approximately 12 inches (30 cm) long and opening 32 is approximately 1⅞ (2.2 cm) inches. The tee opening 38 is approximately 11/16 inches.

A series of marks or numbers maybe placed along the vertical shaft 14 to indicate the height of the horizontal shaft 30 or a number corresponding to that opening.

As shown in FIG. 5, as the player P begins using the golf swing trainer 10, the horizontal shaft 30 is positioned next to the top of the vertical shaft 14. A golf ball 50 would be placed on the golf tee 40 and the player would practice hitting the golf ball 50 off the tee 40. As the player becomes more and more proficient in being able to hit the golf ball 50 in this raised position, the player or instructor would gradually decrease the height of the horizontal shaft 30, as shown in FIG. 6. Again, the player P would continue to practice using the golf swing trainer 10 at this lower setting until the player felt proficient at this lower height. If the player was to hit the horizontal shaft 30 it would merely rotate about the vertical shaft 14. The angle of the flattened portion 36 of the horizontal shaft 30 permits the tee 40 to be maintained vertically while permitting the free rotation of the horizontal shaft 30.

In this way, the flatter better golf swing would be achieved. The golf swing trainer 10 is easily disassembled for facilitating its storage and portability. At any time, the golf swing trainer 10 can be assembled and the player can practice the golf swing.

While the invention has been described in association of the preferred embodiment, it is appreciated that variations to the present invention as described can be devised without departing of the scope of the invention.

What is claimed is:

1. A golf swing trainer comprising a support plate, an elongated vertical shaft having an upper end and a lower end, said vertical shaft extending vertically from said support plate at its lower end, a generally horizontal shaft having a first end and a second end extending from said vertical shaft, said horizontal shaft slidably mounted on said vertical shaft at its first end whereby said horizontal shaft is capable of rotating in a horizontal plane about said vertical shaft and sliding along said shaft vertically, means for fixing said horizontal shaft at selected vertical positions along said vertical shaft without restricting the horizontal rotation of said horizontal shaft whereby said horizontal shaft may be moved between a lower position proximate said support plate and a higher position proximate the upper end of said vertical shaft, and means including a flexible tee associated with said horizontal shaft for supporting a golf ball proximate the second end of said horizontal shaft so that a golf ball may be hit off said tee.

2. The golf swing trainer of claim 1 in which said vertical shaft has a series of openings in said shaft and means for engaging said openings for supporting said horizontal shaft at selected heights.

3. The golf swing trainer of claim 2 in which said means for supporting said horizontal shaft is a removable pin engaging an opening in said vertical shaft.

4. The golf swing trainer of claim 1 in which said horizontal shaft is supported by said vertical shaft at its said first end at an angle relative to said vertical shaft and said horizontal shaft has a portion at its said second end at an angle to the central axis of said horizontal shaft so that said portion is generally horizontal to said support plate.

5. The golf swing trainer of claim 1 in which said vertical shaft is attached to said support plate at a position other than the geometric center of said support plate.

* * * * *